US007237389B2

(12) United States Patent
Ryan et al.

(10) Patent No.: US 7,237,389 B2
(45) Date of Patent: Jul. 3, 2007

(54) ATTACHMENT SYSTEM FOR CERAMIC COMBUSTOR LINER

(75) Inventors: William R. Ryan, Oviedo, FL (US); Robert J. Bland, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 285 days.

(21) Appl. No.: 10/992,185

(22) Filed: Nov. 18, 2004

(65) Prior Publication Data

US 2006/0101827 A1 May 18, 2006

(51) Int. Cl.
*F02C 7/20* (2006.01)
*F02C 3/00* (2006.01)
*F23R 3/00* (2006.01)

(52) U.S. Cl. ..... 60/800; 60/753

(58) Field of Classification Search ..... 60/800, 60/737, 746, 747, 748, 753
See application file for complete search history.

(56) References Cited

U.S. PATENT DOCUMENTS 4,380,896 A 4/1983 Wiebe
5,285,632 A 2/1994 Halila
5,291,732 A 3/1994 Halila
5,291,733 A 3/1994 Halila
5,333,443 A 8/1994 Halila
5,363,643 A 11/1994 Halila
5,687,572 A 11/1997 Schrantz et al.
6,082,111 A * 7/2000 Stokes ..... 60/737
6,216,442 B1 4/2001 Belsom et al.
6,351,949 B1 3/2002 Rice et al.
6,397,603 B1 * 6/2002 Edmondson et al. ..... 60/753
6,895,757 B2 * 5/2005 Mitchell et al. ..... 60/772
2002/0184886 A1 12/2002 Calvez et al.

FOREIGN PATENT DOCUMENTS

EP 1 152 191 A2 11/2001

* cited by examiner

*Primary Examiner*—Ted Kim

(57) ABSTRACT

Aspects of the invention relate to a system for attaching a ceramic liner to a non-ceramic combustor head-end component while accommodating different rates of thermal expansion of these components. One end of the liner can be received within a slot formed by the combustor head-end component. The liner can be held in place by a plurality of pins with each pin passing through a pair of aligned openings in the liner and the head-end component. The end of the liner can be spaced from each of the walls of the slot so as to form a series of gaps in fluid communication. The gaps and the pins can accommodate differential thermal expansion between the liner and combustor head-end component. If desired, at least some of the gaps can be tightly controlled so as to regulate air leakage around the end of the liner.

12 Claims, 5 Drawing Sheets

ATTACHMENT SYSTEM FOR CERAMIC COMBUSTOR LINER

FIELD OF THE INVENTION

The invention relates in general to turbine engines and, more particularly, to a system for attaching a ceramic combustor liner to combustor components made of dissimilar materials.

BACKGROUND OF THE INVENTION

Ceramic materials are able to withstand much higher temperatures than metals. Accordingly, ceramics are well suited for high temperature applications. For instance, in the context of turbine engines, it would be advantageous to replace a metal combustor liner with a liner made of ceramic. A ceramic liner would be able to better tolerate the high thermal loads of combustion and, in turn, less air would need to be diverted from the combustion process for purposes of cooling the liner, allowing for potential increases in engine efficiency and reductions in the production of undesired combustion byproducts, such as NOx and CO.

However, these advantages are hampered by the difficulty of integrating a ceramic liner in a turbine engine combustor. Normally, each end of the liner is attached to one or more nearby combustor components, which are typically made of metal or other non-ceramic material. As the parts are heated, differences in the rate of thermal expansion of the ceramic liner and the components to which the liner is attached can subject the liner to unacceptably high stresses. Damage to the liner can result in extended outages and costly repair or replacement. As a result of such concerns, prior ceramic/non-ceramic attachment systems have relied on non-traditional and complex methods to protect the ceramic.

Thus, there is a need for a simplified system of attaching a ceramic liner to neighboring non-ceramic combustor components, while accommodating unequal rates of thermal expansion of such components.

SUMMARY OF THE INVENTION

Embodiments of the invention relate to an attachment system for a ceramic turbine engine combustor liner. The system includes at least one head-end combustor component, a ceramic combustor liner and a plurality of pins. The at least one combustor head-end component, which can be made of metal, forms a substantially annular slot. The slot is defined by an inner radial wall, an outer radial wall, and a back wall. A plurality of openings extend about and radially through the outer radial wall. In one embodiment, the combustor head-end component can include an extension plate and a connecting part. In such case, the extension plate can define at least in part the radial outer wall of the slot; the connecting part can define at least in part the radial inner wall of the back wall of the slot.

The ceramic combustor liner has an axial upstream end, an axial downstream end, an inner peripheral surface and an outer peripheral surface. A plurality of radial openings extend radially through the liner near the axial upstream end and are distributed about the periphery of the liner. The liner can be made of CMC. In one embodiment, the axial upstream end of the liner and a region adjacent thereto, which includes the openings, can be made of structural CMC.

The axial upstream end of the liner is positioned within the slot such that the openings in the liner substantially align with the openings in the outer radial wall of the combustor head-end component. One of the plurality of pins is received within each pair of the substantially aligned openings. The pins are radially fixed to a portion of the combustor head-end component. The pins can accommodate relative movement of the liner and the at least one combustor head-end component due to different rates of radial thermal expansion of these components. The pins can be made of substantially the same material as the at least one head-end combustor component.

The axial upstream end of the combustor liner is positioned in the slot so as to form a first gap, a second gap and a third gap. The gaps are in fluid communication. The first gap is defined between the outer peripheral surface of the liner and the radially outer wall of the slot. In one embodiment, the first gap can be about 0.05 inches in the cold condition. The second gap is defined between the inner peripheral surface of the liner and the radially inner wall of the slot. The second gap can be about 0.05 inches in the cold condition. In one embodiment, the width of the first gap can be less than the width of the second gap.

The third gap is defined between the axial upstream end of the liner and the back wall of the slot. Air leakage through the gaps can be controlled by positioning the axial upstream end of the liner substantially adjacent to the back wall of the slot. In one embodiment, the third gap can be about 0.01 inches in the cold condition. Alternatively, the third gap can be less than or equal to 0.01 inches in the cold condition. The width of the third gap can be substantially less than the width of the second gap.

In one embodiment, the attachment system can further include a pilot nozzle and a pilot cone surrounding the pilot nozzle. The pilot cone can extend into the axial upstream end of the liner such that the pins and slot are positioned axially upstream of the end of the pilot cone. Thus, combustion can occur downstream of the pilot nozzle.

In one embodiment, the attachment system according to aspects of the invention can include at least one spring positioned between and acting against the radially outer wall of the slot and the outer peripheral surface of the liner. The spring can be a helical spring. One of the plurality of pins can extend through the spring. In one instance, a spring can be associated with each of the plurality of pins.

The attachment system according to aspects of the invention can also include a grommet received within one of the openings in the liner such that direct contact between the pins and the ceramic liner is prevented. The grommet can made of the same material as the pins.

DETAILED DESCRIPTION OF EMBODIMENTS OF THE INVENTION

Aspects of the present invention are directed to a system for attaching a ceramic liner to non-ceramic combustor components. Embodiments of the invention can accommodate the differing rates of thermal expansion of such dissimilar materials. In addition, embodiments of the invention can minimize or control air leakage at or around the attachment interface.

Embodiments of the invention will be explained in the context of one possible attachment system, but the detailed description is intended only as exemplary. Embodiments of the invention are shown in FIGS. 1–5, but the present invention is not limited to the illustrated structure or application.

Aspects according to embodiments of the invention can be applied to the combustor section 10 of a turbine engine. In some turbine engines, the fuel injection/fuel-air premixing portion of the combustor is known as the head-end 12. Embodiments of the invention can include at least one head-end combustor component. The specific components and geometry in the area of the head-end 12 can vary from combustor to combustor, and embodiments of the invention are not intended to be limited to a specific head-end combustor component.

Figure 1:
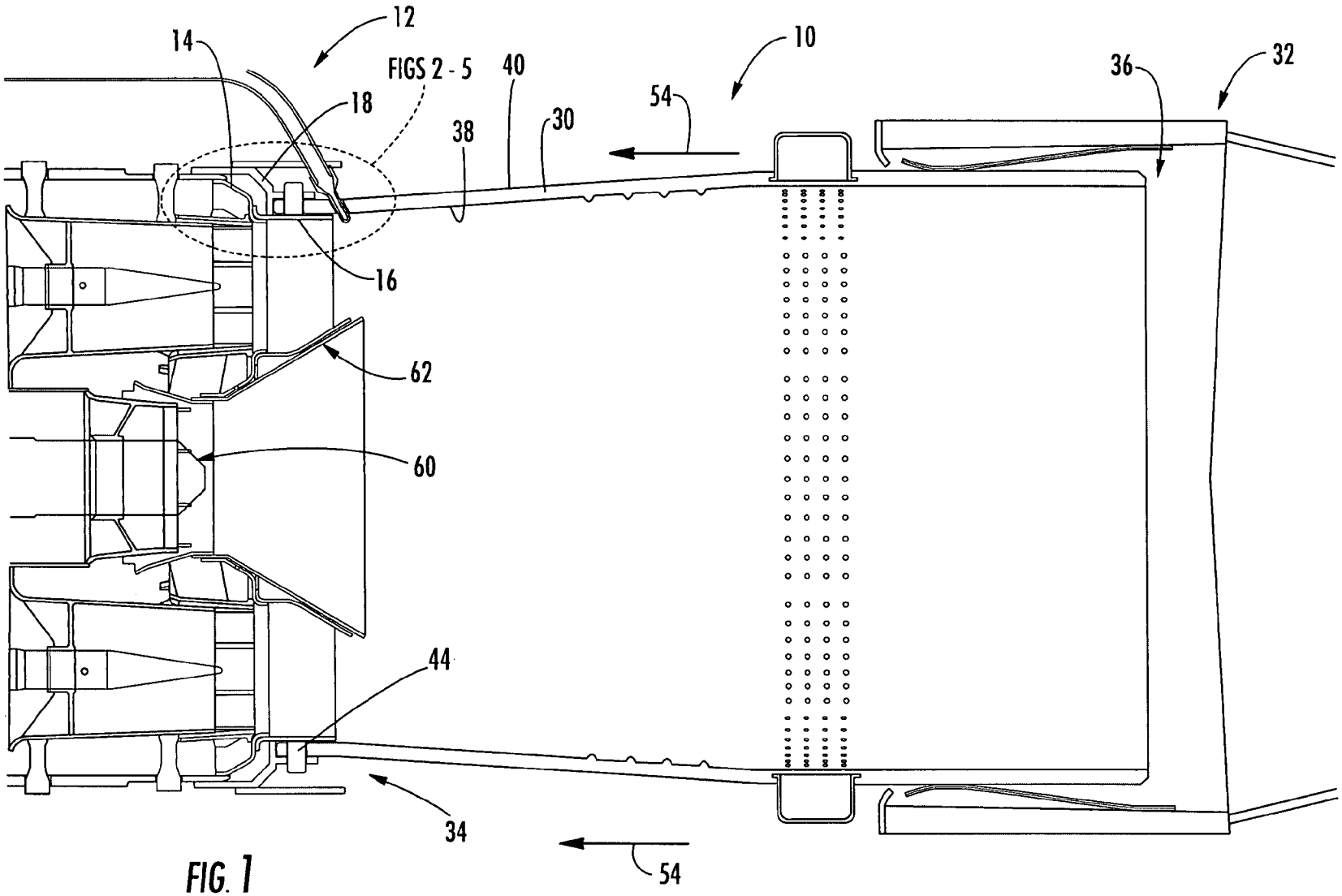
FIG. 1 is a side cross-sectional view of a portion of the combustor section of a turbine engine according to embodiments of the invention.

The head-end combustor component can be a single component or it can include multiple components. One example of a multi-part combustor head-end component is shown in FIG. 1. The head-end combustor component can include a base plate 14, an extension plate 16 and a connecting part 18. Each of these components can have numerous conformations, and embodiments of the invention are not limited to any specific conformation or arrangement. Further, it should be noted that the use of the term "plate" in connection with the base plate 14 and the extension plate 16 is merely for convenience to facilitate discussion. While the term "plate" may connote a flat structure, the base plate 14 and extension plate 16 according to embodiments of the invention are not limited to flat structures. Indeed, as previously noted, the base plate 14 and the extension plate 16 can have any of a number of conformations, including generally cylindrical or annular as shown in FIGS. 1–5. In one embodiment, the extension plate 16 can be integral with the base plate 14 such as by welding, brazing, adhesives, or fasteners. Alternatively, the base plate 14 and the extension plate 16 can be a unitary structure. Likewise, the connecting part 18 can be integral with at least the extension plate 16, such as by welding. It is also possible for the extension plate 16 and the connecting part 18 to be a unitary structure. In some situations, the connecting part 18 and the extension plate 16 may not be attached together at all. Further, each of the base plate 14, the extension plate 16 and the connecting part 16 can be attached to other components of the combustor head-end, as is generally shown in FIG. 1.

In some embodiments, there may not even be a connecting part 18 as the base plate 14 and/or the extension plate 16 can be configured to include any of the features that the connecting part 18 provides. The base plate 14, the extension plate 16 and/or the connecting part 18 can be formed in a variety of ways including, for example, stamping, casting, machining, and/or bending. These components can be made of stainless steels or nickel based alloys, but various other materials are possible.

Figure 2:
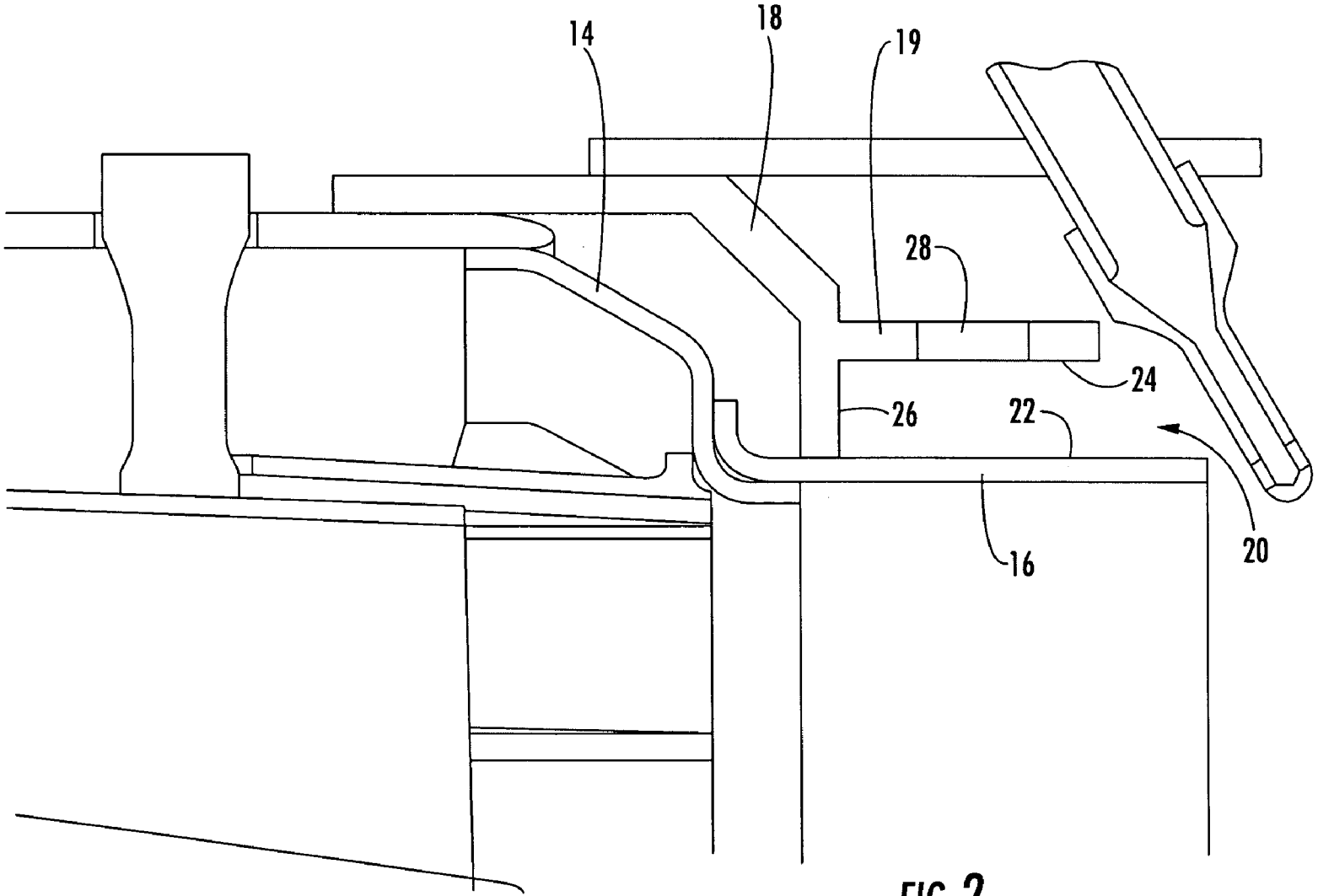
FIG. 2 is a close-up view of a portion of the head-end of the combustor with the liner removed, showing a substantially annular slot formed by the combustor head-end component, to provide a method of attachment to a ceramic liner according to embodiments of the invention.

Regardless of whether the combustor head-end component includes one or more than one component, the head-end combustor component can form a substantially annular slot 20, as shown in FIG. 2. The slot 20 can be defined by an inner radial wall 22, an outer radial wall 24, and a back wall 26. With reference to the combustor head-end components described above, a portion of the extension plate 16 can define at least in part the radial inner wall 22 of the slot; a portion of the connecting part 18 can define at least in part the radial outer wall 24 and the back wall 26 of the slot 20. In one embodiment, the slot 20 can be generally rectangular in cross-section, as shown in FIG. 2. However, other cross-sectional geometries are possible, and embodiments of the invention are not limited to any particular cross-sectional geometry for the slot 20.

A plurality of radial openings 28 can be provided in the outer radial wall 24 of the slot 20. The openings 28 can extend about and radially through the outer radial wall 24, which can be, for example, a protruding portion 19 of the connecting part 18. The openings 28 can be made by any of a number of machining or other processes. The openings 28 can have any of a number of cross-sectional geometries including circular, polygonal, rectangular, or triangular, just to name a few. While it is preferred if all of the openings 28 are substantially identical, at least one of the openings 28 can be different from the other openings 28 at least with respect to its geometry and/or size. The openings 28 can be spaced substantially equidistantly about the outer radial wall 24. Alternatively, the openings 28 can be spaced according to a pattern, regular or irregular, or to no pattern at all. Further, the openings 28 are preferably substantially aligned about the outer radial wall 24, that is, in the annular direction, but such alignment is not necessary as one of more of the openings 28 can be offset from the other openings 28.

An attachment system according to aspects of the invention can further include a combustor liner 30. Combustor liners are well known in the art. As shown in FIG. 1, the liner 30 can generally extend between the head-end 12 of the combustor and the transition duct 32. The liner 30 can have an axial upstream end 34 and an axial downstream end 36. The terms "upstream" and "downstream" used herein refer to the relative position of the ends of the liner 30 with respect to the direction of gas flow through the liner 30.

The liner 30 can be a generally hollow component with an inner peripheral surface 38 and an outer peripheral surface 40. Further, the liner 30 can have numerous conformations. In one embodiment, the liner 30 can be substantially cylindrical, which includes true cylindrical and deviations therefrom. However, a liner 30 according to embodiments of the invention is not limited to any specific geometry or conformation.

A plurality of radial openings 42 can extend radially through the liner 30 near the axial upstream end 34. The plurality of openings 42 can be distributed about the periphery of the liner 30. The openings 42 can be provided in the liner 30 by any of a variety of machining processes, as will be appreciated by one skilled in the art.

There can be any number of openings 42. In one embodiment, there can be at least twelve openings 42. The openings 42 can be spaced equidistantly about the periphery of the liner 30. In one embodiment, the openings 42 can be spaced according to a regular or irregular pattern; alternatively, the openings 42 may not follow any particular pattern at all. The openings 42 can all be substantially aligned in a row about the periphery of the liner. In one embodiment, one or more of the openings 42 can be offset from the other openings 42. Each of the plurality of openings 42 can be substantially identical. However, in some instances, one or more of the openings 42 can be different from the other openings 42. It is preferred if the openings 42 in the liner 30 substantially correspond to the openings 28 in the combustor head-end component at least in terms of size, shape, pattern, and/or annular alignment.

The liner 30 can be made of ceramic, which is intended to include ceramics as well as ceramic matrix composites (CMC). In one embodiment, the entire liner 30 can be made of CMC. In another embodiment, the axial upstream end 34 of the liner 30 and a region adjacent thereto can be made entirely of structural CMC. This adjacent region can include the plurality of openings 42 in the liner 30. In such case, the rest of the liner 30 can be made of ceramic, a different CMC or other material. Using CMC only at the axial upstream end 34 of the liner can provide structural strength in an area where there is little need for a material with a low coefficient of thermal expansion, as will be explained in greater detail later.

An attachment system according to embodiments of the invention can further include a plurality of pins 44. The pins 44 can have any of a number of geometries and the cross-sectional geometry of the pin 44 will generally correspond to the cross-sectional geometry of the openings 42 in the liner 30 and the openings 28 in the head-end combustor component such that the pins 44 can be received therein. The pins 44 can be straight or tapered along their entire length or just in localized areas. For instance, the ends 46 of the pins 44 can be tapered to facilitate installation (not shown).

In one embodiment, the pins 44 can be substantially cylindrical with a substantially circular cross-section. In such case, the pins 44 can be about 0.5 inches in diameter. However, embodiments of the invention are not limited to any specific cross-sectional geometry of the pins 44. The quantity of pins 44 needed depends in part on the number of openings 42 provided in the liner 30; however, a pin 44 does not need to be provided for every opening 42 in the liner 30.

Preferably, the pins 44 are substantially identical to each other, but, depending on design criteria, space constraints and/or other considerations, the pins 44 can be different. The pins 44 can be made of the same material as the head-end combustor component. Alternatively, the pins 44 can be made of a different material, but it is preferred if the pins 44 are made of a material with a substantially identical coefficient of thermal expansion as the head-end combustor component. In one embodiment, the pins 44 can be made of stainless steel. The pins 44 can be made by almost any process such as by machining.

Figure 3:
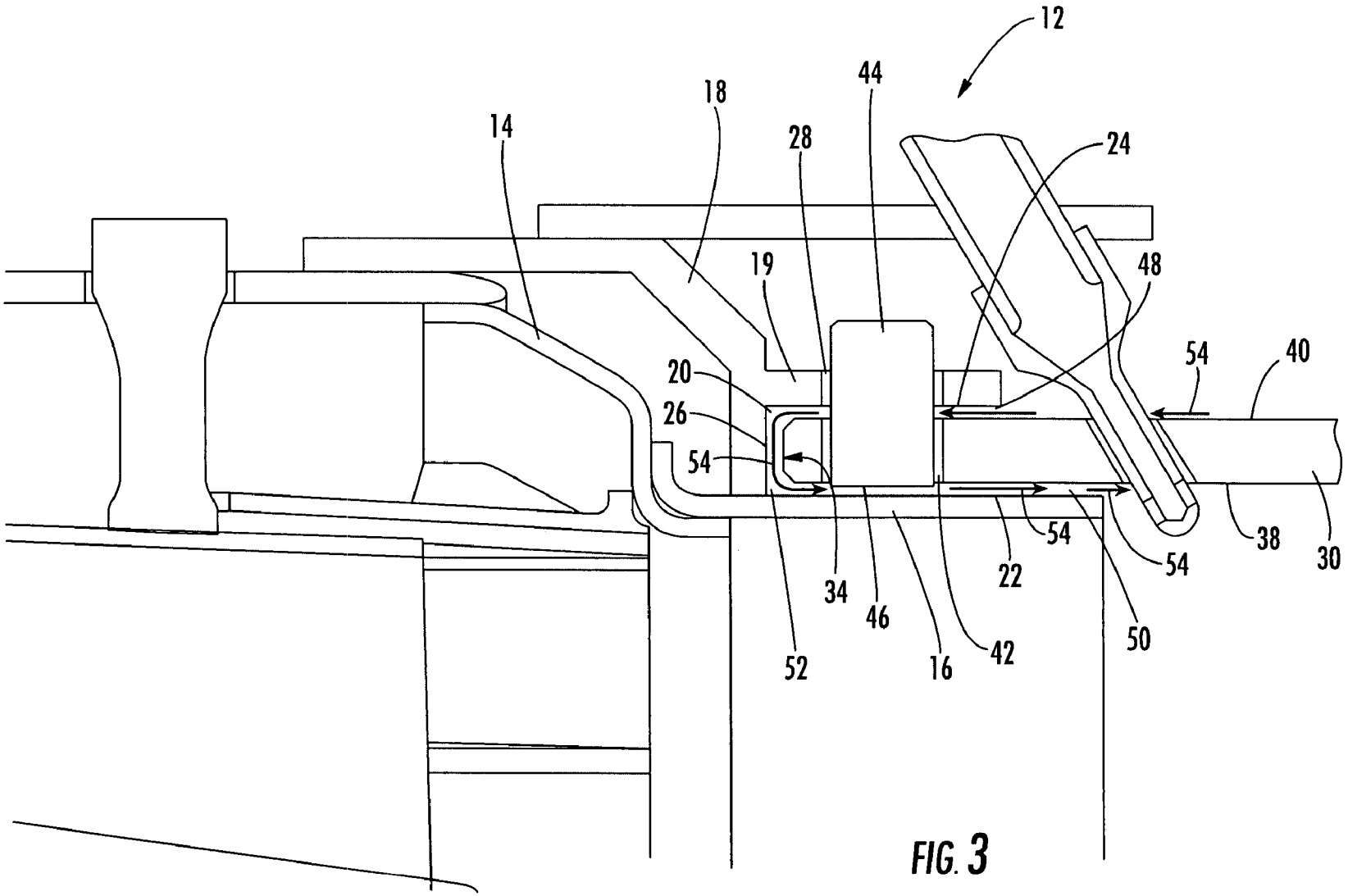
FIG. 3 is a close-up view of the interface between the axial upstream end of the liner and the downstream end of the combustor head-end, showing one attachment system according to embodiments of the invention.

Having described individual components according to embodiments of the invention, one manner of attaching the combustor liner 30 to the head-end 12 of the combustor 10 will now be described. The axial upstream end 34 of the liner 30 can be positioned within the slot 20. The liner 30 can be adjusted until the openings 42 in the liner 30 are substantially aligned with the openings 28 in the outer radial wall 24 of the combustor head-end component. "Substantially aligned" means that the openings 42 in the liner 30 are sufficiently aligned with the openings 28 in the combustor head-end component such that one of the pins 44 can be inserted though each pair of aligned openings 28,42. Once aligned, a pin 44 can be received within each pair of the substantially aligned openings 28,42. To prevent radial movement of the pins 44, the pins 44 can be fixed to a portion of the combustor head-end component by, for example, welding, brazing, adhesives or interference fit. For instance, as shown in FIG. 3, a portion of the pin 44 can jut radially outward from the connecting part 18, such as protruding portion 19, and can be welded to the connecting part 18.

As will be appreciated by one skilled in the art, the pins 44 at different locations about the periphery of the liner 30 can provide different types of support and restraint. For instance, the pins 44 located in the substantially horizontal operational positions (such as, for example, in the 3 o'clock and the 9 o'clock positions) can prevent radial up and down movement of the liner 30. In contrast, the pins 44 located in the substantially vertical operational positions (for instance, the 12 o'clock and the 6 o'clock positions) can prevent radial left and right motion of the liner 30. In addition to a positioning and holding function, the pins 44 can accommodate the relative movement of the liner 30 and the head-end combustor component as . these components thermally expand or contract in the radial direction during engine operation, as will be described later.

The axial upstream end 34 of the combustor liner 30 can be spaced from each of the walls of the slot 20. In such case, a series of gaps can be formed between the walls 22,24,26 of the slot 20 and the liner 30. A first gap 48 can formed between the outer peripheral surface 40 of the liner 30 and the radially outer wall 24 of the slot 20. A second gap 50 can be formed between the inner peripheral surface 38 of the liner 30 and the radially inner wall 22 of the slot 20. The first and second gaps 48,50 can allow for different rates of thermal expansion of the axial upstream end 34 of the liner 30 and the combustor head-end component, such as the extension plate 16 and the connecting part 18. The gaps 48,50 can be sized based on the expected radial expansion of the liner 30 and combustor head-end component using the known thermal expansivities of the materials selected for the liner 30 and the combustor head-end component.

In one embodiment, the first gap 48 can be about 0.05 inches. However, the first gap 48 can be as small as manufacturing tolerances allow so long as the liner can be slipped into the slot 20 in the cold condition (that is, under ambient conditions). The first gap 48 can theoretically be zero in the cold condition when the combustor head-end component has a greater rate of thermal expansion than the liner 30. In such case, the first gap 48 will become larger as the parts heat up because the head-end combustor component, such as a metal connecting part 18, will expand radially outward at a greater rate than the ceramic liner 30.

In contrast, the second gap 50 can be sized to allow for the relative thermal expansion between the extension plate 16 and the liner 30 in the radial direction. That is, the second gap 50 can be sized to allow for a greater rate of thermal expansion of a metal head-end combustor component, such as the extension plate 16, compared to the ceramic liner 30. If the second gap 50 is not properly sized, the head-end combustor component, such as the extension plate 16, can expand into and possibly damage the ceramic liner 30. In one embodiment, the second gap 50 can be at least about 0.05 inches. It should be noted that the end 46 of the pin 44 can be spaced from the inner radial wall 22 of the slot 20. However, in instances where the pin 44 is made of the same material as the head-end combustor component, no gap is needed as there will not be any differential thermal expansion.

A third gap 52 can be formed between the axial upstream end 34 of the liner 30 and the back wall 26 of the slot 20. The first, second and third gaps 48,50,52 can be in fluid communication so as to define a path through which compressed air 54 from the compressor section (not shown) of the turbine engine can enter and pass into the liner 30. While such a leak path is typically not desired, the gaps 48,50,52 should nevertheless be provided to avoid any interferences that may arise after the parts thermally expand.

However, the third gap 52 can be sized to control air leakage through the interface between the liner 30 and the head-end combustor component. To that end, the axial upstream end 34 of the liner 30 can be positioned substantially adjacent to the back wall so as to restrict air flow through the third gap 52. That is, the width of the third gap 52 can be tightly toleranced. In one embodiment, the third gap can be from about 0.005 inches to about 0.01 inches. In another embodiment, the width of the third gap 52 can be less than or equal to 0.01 inches. Preferably, the third gap 52 is as small as manufacturing tolerances will allow. The third gap 52 can theoretically be zero in the cold condition when the combustor head-end component has a greater rate of thermal expansion than the liner 30.

As the parts heat up, the combustor head-end component and the liner 30 can experience thermal expansion in the axial direction. The rate of axial thermal expansion of the combustor head-end component (such as connecting part 18 forming back wall 26 of the slot 20) will be greater than the rate of axial thermal expansion of the axial upstream end 34 of the liner 30. Consequently, the size of the third gap 52 can increase during engine operation. However, the difference in the relative amount of expansion can be expected to be small, for the amount of thermal expansion of the axial upstream end 34 of the liner 30 is proportional to the length of the liner from the centerline of the pins 44 to the upstream end 34 of the liner 60. The small difference in relative expansion between the upstream end 34 of the liner 60 and the connecting part 18 means that a small third gap 52 can be maintained, if desired, to limit air flow through the interface between the liner 60 and the head-end assembly.

Figure 5:
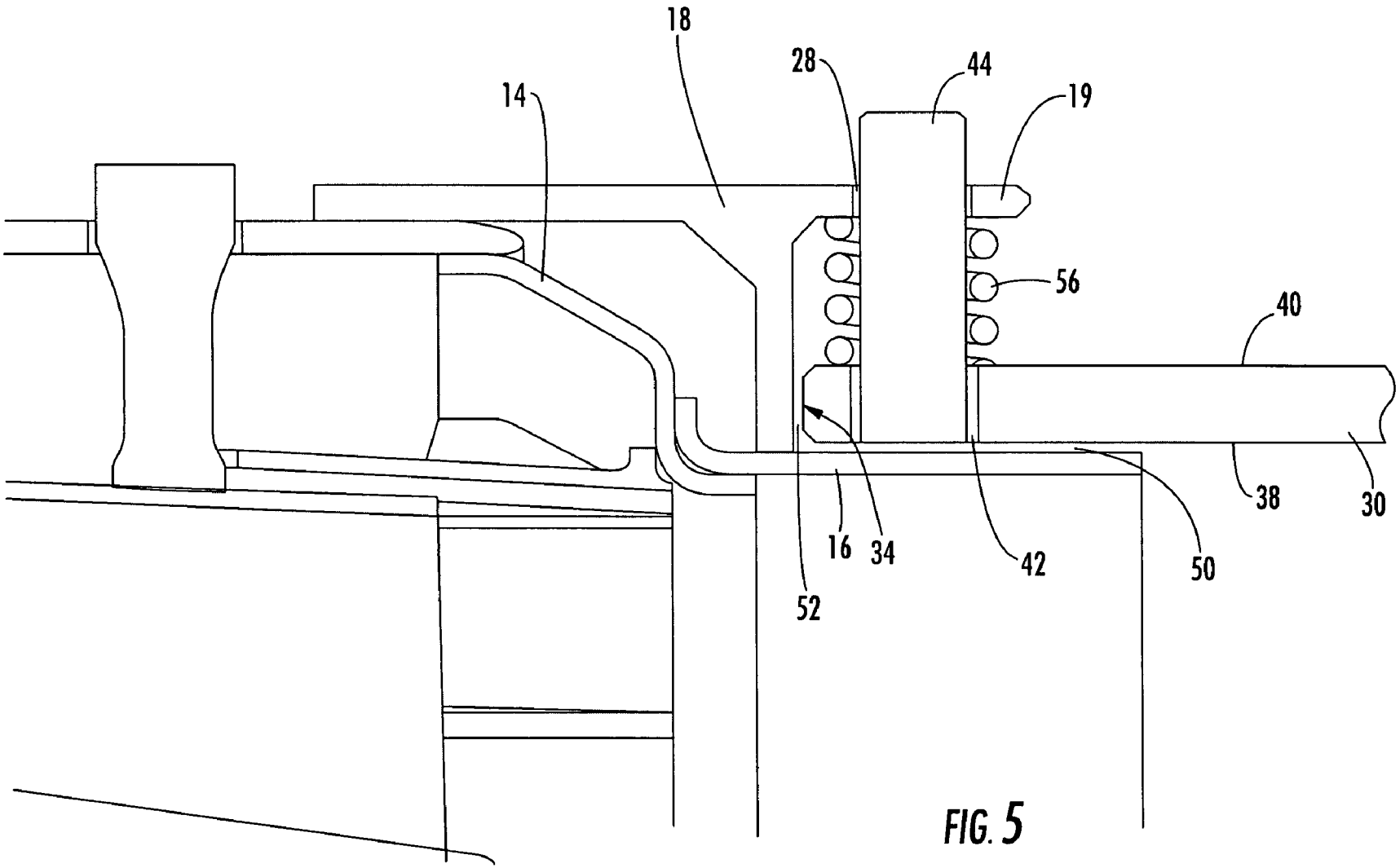
FIG. 5 is a close-up view of the interface between the axial upstream end of the liner and the head-end of the combustor, showing another attachment system according to embodiments of the invention.

Ideally, the tolerances between the openings 28,42 and the pins 44 can be tightly controlled. However, one concern with such an approach is the binding of the pins 44 that may occur as the parts heat up. Such concerns can be mitigated by loosening the tolerances on the pins 44 and/or the openings 28,42. By loosening the tolerances, the pins 44 may rattle within the openings 28,42, but, to prevent such rattling, one or more springs 56 can be positioned between and act against the radially outer wall 24 of the slot 20 and the outer peripheral surface 40 of the liner 30, as shown in FIG. 5. The slot 20 can be configured as needed to receive the spring 56, such as by modifying the connecting part 18, as shown in FIG. 5. In one embodiment, a spring 56 can be provided for each pin 44. The pins 44 can extend through the spring 44. In one embodiment, the spring 44 can be a helical spring like the one shown in FIG. 5.

Figure 4:
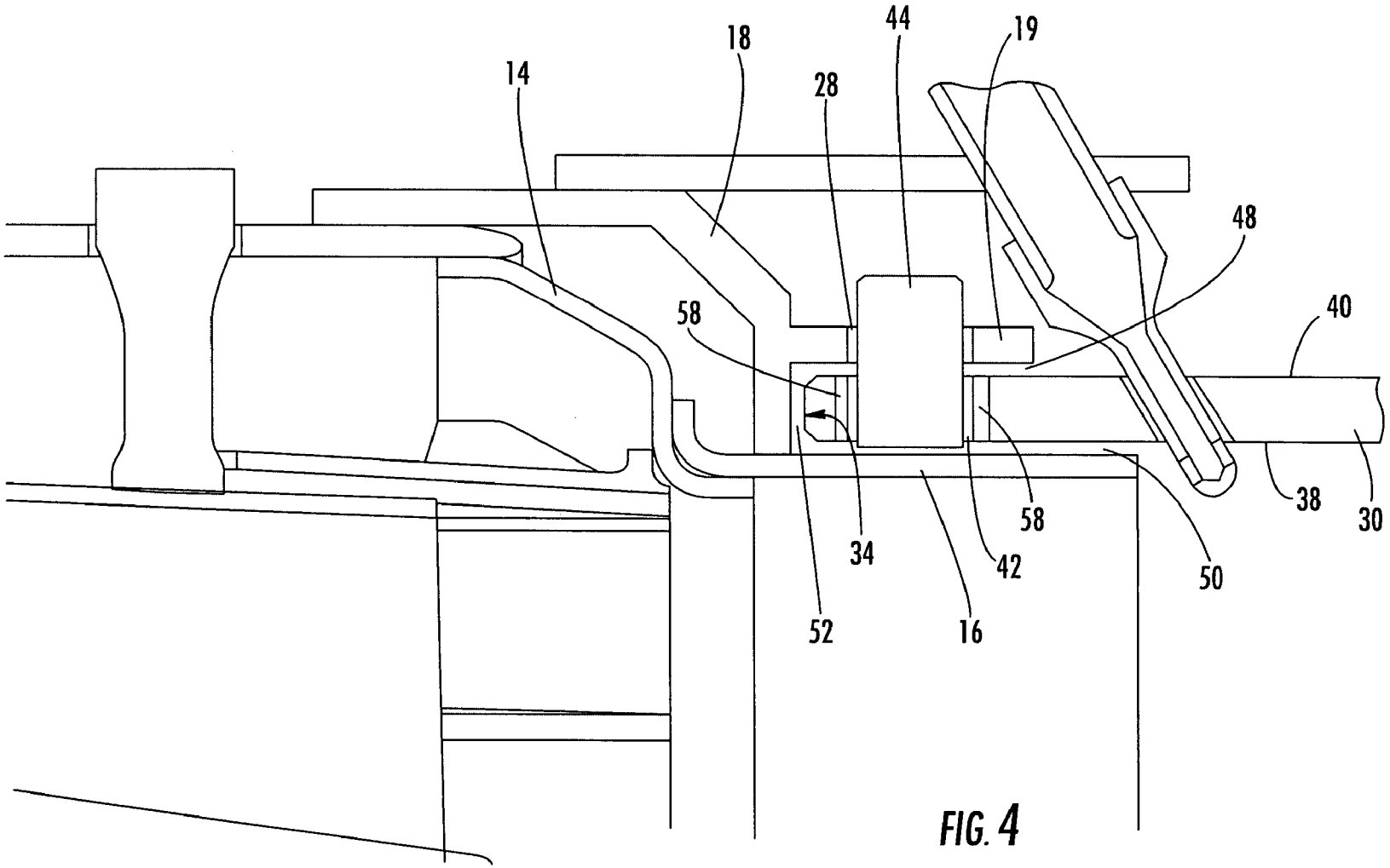
FIG. 4 is a close-up view of the interface between the axial upstream end of the liner and the combustor head-end, showing an alternative attachment system according to embodiments of the invention.

Alternatively, the liner 30 can be further protected by preventing the liner 30 from directly contacting the pins 44 by sliding engagement or otherwise. To that end, a grommet 58 can be disposed within one or more of the openings 42 in the liner 30, as shown in FIG. 4. The grommet 58 can be made of metal, and preferably the grommet 58 is made of substantially the same material as the pins 44. The grommet 58 can be held within the openings 42 by adhesives, frictional or mechanical engagement, just to name a few possibilities. When a grommet 58 is used, sliding engagement between the ceramic liner 30 and the pin 44 is prevented, thereby avoiding potentially high forces associated with such engagement.

Having described the individual components of the attachment system according to embodiments of the invention and their assembly, one manner of the operation of such a system will now be described. The following description is merely an example of one operational mode of an attachment system according to embodiments of the invention.

At the outset, a turbine engine combustor 10 is provided. In addition to the details of the combustor head-end 12 presented above, the combustor 10 can include a pilot nozzle 60 and a pilot cone 62 surrounding the pilot nozzle 60, as are known in the art. The pilot cone 62 can extend into the axial upstream end 34 of the liner 30. Preferably, the pins 44 and slot 20 are positioned axially upstream of the end of the pilot cone 62. While combustion occurs downstream of the pilot nozzle 60, the pins 44 and nearby combustor components can be shielded from large thermal loads of combustion due to their axial upstream positioning and the protection of the pilot cone 62. Due to such positioning, the attachment system according to embodiments of the invention is not subjected to the highest temperatures of combustion.

The operation of a combustor section of a turbine engine is well known. As shown in FIG. 1, compressed air 54 from the compressor section (not shown) of the engine flows about the outside of the liner 30 and into the head-end 12 of the combustor. Fuel is mixed with this air and the air/fuel mixture can be ignited by the flame from the pilot nozzle 60 inside of the liner 30. However, as shown in FIG. 3, a portion of the compressed air 54 may pass around the axial upstream end 34 of the liner 30 through the path created by the gaps 48,50,52. Such air leakage is undesired because when the air infiltrates the combustion chamber, there can be an increase in NOx production during combustion. Though the gaps 48,50,52 cannot be completely eliminated, the widths of the gaps 48,50,52 can be tightly controlled, as previously mentioned, so as to minimize airflow through the gaps 48,50,52. By controlling the width of the gaps 48,50,52, NOx production can be limited.

As the temperature in the combustor section increases, the head-end combustor component and the liner 30 will both expand in the radial outward direction. However, the combustor head-end component will expand at a greater rate compared to the ceramic liner 30. Such unequal expansion is accommodated by the pins 44. That is, the pins 44 allow relative movement of the liner 30 and the combustor head-end component. In addition, such relative movement is permitted by the gaps 48,50,52.

Thus, the combustor head-end component, such as extension plate 16, is prevented from expanding into the liner 30, thereby preventing damage to the liner 30. As the combustor heats up, the gaps may become slightly larger or smaller, depending on a variety of factors as one skilled in the art would appreciate. Preferably, under all expected operational temperatures, the gaps 48,50,52 are not reduced to zero; that is, the liner 30 does not contact any of the combustor head-end components forming the slot 20. The leakage of air around the axial upstream end 34 of the liner 30 can be controlled by the widths of the gaps 48,50,52, particularly by the width of the third gap 52.

The foregoing description of an attachment system is provided in the context of combustor system according to aspects of the invention. Of course, aspects of the invention can be employed with respect to myriad combustor designs, as one skilled in the art would appreciate. Embodiments of the invention may have application to other sections of the engine in some instances. Thus, it will of course be understood that the invention is not limited to the specific details described herein, which are given by way of example only, and that various modifications and alterations are possible within the scope of the invention as defined in the following claims.

What is claimed is:

1. An attachment system for a ceramic turbine engine combustor liner comprising:

at least one combustor head-end component forming a substantially annular slot, the slot being defined by an inner radial wall, an outer radial wall, and a back wall, wherein a plurality of openings extend about and radially through the outer radial wall;

a ceramic combustor liner having an axial upstream end, an axial downstream end, an inner peripheral surface and an outer peripheral surface, wherein a plurality of radial openings extend radially through the liner near the axial upstream end and are distributed about the periphery of the liner, the axial upstream end of the liner being positioned within the slot such that the openings in the liner substantially align with the openings in the outer radial wall of the combustor head-end component; and a plurality of pins, each of the plurality of pins being received within a pair of the substantially aligned openings, the pins being radially fixed to a portion of the combustor head-end component;

a helical spring positioned concentrically around at least one of the plurality of pins and bearing against the radially outer wall of the slot and the outer peripheral surface of the liner;

the axial upstream end of the combustor liner being positioned in the slot so as to form a first gap between the outer peripheral surface of the liner and the radially outer wall of the slot, a second gap between the inner peripheral surface of the liner and the radially inner wall of the slot, and a third gap between the axial upstream end of the liner and the back wall of the slot, wherein the gaps are in fluid communication, whereby the axial upstream end of the liner is positioned substantially adjacent to the back wall so as to control air leakage through the gaps, whereby the pins accommodate relative movement of the liner and the at least one combustor head-end component due to different rates of radial thermal expansion of these components.

2. The attachment system of claim 1 wherein the at least one head-end combustor component is made of metal.

3. The attachment system of claim 1 wherein the axial upstream end of the liner and a region adjacent thereto including the openings is made of structural CMC.

4. The attachment system of claim 1 wherein the liner is made of CMC.

5. The attachment system of claim 1 wherein the third gap is about 0.01 inches in the cold condition, whereby leakage of air around the axial upstream end of the liner is minimized.

6. The attachment system of claim 1 wherein the third gap is less than or equal to 0.01 inches in the cold condition, whereby leakage of air around the axial upstream end of the liner is minimized.

7. The attachment system of claim 1 wherein the width of the third gap is substantially less than the width of the second gap.

8. The attachment system of claim 1 further comprising a pilot nozzle and a pilot cone surrounding the pilot nozzle, wherein the pilot cone extends into the axial upstream end of the liner, wherein the pins and slot are positioned axially upstream of the end of the pilot cone, whereby combustion occurs downstream of the pilot nozzle.

9. The attachment system of claim 1 wherein the first gap is about 0.05 inches in the cold condition.

10. The attachment system of claim 1 wherein the second gap is about 0.05 inches in the cold condition.

11. The attachment system of claim 1 wherein the pins are made of substantially the same material as the at least one head-end combustor component.

12. The attachment system of claim 1 wherein the combustor head-end component comprises an extension plate and a connecting part, wherein the extension plate defines at least in part the radial outer wall of the slot, wherein the connecting part defines at least in part the radial inner wall of the back wall of the slot.

* * * * *